US011469006B2

(12) United States Patent
Little et al.

(10) Patent No.: US 11,469,006 B2
(45) Date of Patent: Oct. 11, 2022

(54) SUPPRESSION OF RADIONUCLIDE DEPOSITION ON NUCLEAR POWER PLANT COMPONENTS

(71) Applicant: DOMINION ENGINEERING, INC., Reston, VA (US)

(72) Inventors: Michael J. Little, Ashburn, VA (US); Charles R. Marks, McLean, VA (US)

(73) Assignee: DOMINION ENGINEERING, INC., Reston, VA (US)

( * ) Notice: Subject to any disclaimer, the term of this patent is extended or adjusted under 35 U.S.C. 154(b) by 880 days.

(21) Appl. No.: 15/765,097

(22) PCT Filed: Aug. 3, 2017

(86) PCT No.: PCT/US2017/045295
§ 371 (c)(1),
(2) Date: Mar. 30, 2018

(87) PCT Pub. No.: WO2018/027030
PCT Pub. Date: Feb. 8, 2018

(65) Prior Publication Data

US 2018/0286526 A1 Oct. 4, 2018

Related U.S. Application Data

(60) Provisional application No. 62/371,188, filed on Aug. 4, 2016.

(51) Int. Cl.
*G21C 17/022* (2006.01)
*G21C 19/28* (2006.01)
(Continued)

(52) U.S. Cl.
CPC ..... *G21C 19/28* (2013.01); *G21C 17/0225* (2013.01); *C23C 20/02* (2013.01);
(Continued)

(58) Field of Classification Search
CPC ..... G21C 19/28; G21C 17/00; G21C 17/0225
See application file for complete search history.

(56) References Cited

U.S. PATENT DOCUMENTS 4,615,776 A * 10/1986 Sasaki ..... G21F 9/004 204/237
4,756,874 A * 7/1988 Ruiz ..... G21D 1/003 376/306
(Continued)

FOREIGN PATENT DOCUMENTS

BR PI0803710 B1 * 12/2018
CA 2 352 141 4/2001
(Continued)

OTHER PUBLICATIONS

Non-Final Office Action issued in corresponding Japanese Patent Application No. 2018-516416, dated May 28, 2019.
(Continued)

*Primary Examiner* — Lily C Garner
(74) *Attorney, Agent, or Firm* — Pillsbury Winthrop Shaw Pittman LLP

(57) ABSTRACT

A method for depositing zinc on the surfaces of a coolant loop of a nuclear power plant includes: providing within a portion of the coolant loop a treatment solution comprising zinc and optionally one or more noble metals and/or reducing agent(s); allowing the treatment solution to remain in the portion for a treatment period; and removing the treatment solution from the portion. According to various embodiments, an average temperature of the treatment solution over the course of the treatment period is less than 150° C. or 100° C. According to various embodiments, an instantaneous temperature of the treatment solution remains below 150° C. or 100° C. throughout the treatment period. The zinc deposition treatment may be applied (1) before the plant is first put into power-generating operation or (2) during an
(Continued)

outage following power-generating operation and optionally following a chemical decontamination to remove any oxides formed on surfaces of a coolant loop during prior power operation period(s).

36 Claims, 1 Drawing Sheet

(51) Int. Cl.

| | |
|---|---|
| *C23C 22/68* | (2006.01) |
| *C23C 30/00* | (2006.01) |
| *C23C 22/77* | (2006.01) |
| *F01P 7/00* | (2006.01) |
| *C23C 20/02* | (2006.01) |
| *C23C 22/60* | (2006.01) |

(52) U.S. Cl.
CPC ..... *C23C 22/60* (2013.01); *C23C 22/68* (2013.01); *C23C 22/77* (2013.01); *C23C 30/005* (2013.01); *F01P 7/00* (2013.01)

(56) References Cited

U.S. PATENT DOCUMENTS

| | | | | |
|---|---|---|---|---|
| 4,759,900 | A | 7/1988 | Peterson et al. | |
| 4,828,790 | A | 5/1989 | Honda et al. | |
| 4,842,812 | A * | 6/1989 | Panson | G21C 19/303 376/306 |
| 4,950,449 | A | 8/1990 | Petersen et al. | |
| 5,135,709 | A | 8/1992 | Andresen et al. | |
| 5,171,515 | A | 12/1992 | Panson et al. | |
| 5,570,469 | A * | 10/1996 | Soderstrom | B09C 1/02 423/2 |
| 5,581,588 | A | 12/1996 | Andresen | |
| 5,602,888 | A | 2/1997 | Hettiarachchi et al. | |
| 5,625,658 | A | 4/1997 | Lin | |
| 5,768,330 | A | 6/1998 | Andresen et al. | |
| 5,774,516 | A | 6/1998 | Hettiarachchi et al. | |
| 5,790,619 | A | 8/1998 | Peck | |
| 5,818,893 | A | 10/1998 | Hettiarachchi | |
| 5,904,991 | A | 5/1999 | Hettiarachchi | |
| 5,995,576 | A | 11/1999 | Midorikawa et al. | |
| 6,314,153 | B1 | 11/2001 | Henzel et al. | |
| 6,473,480 | B1 | 10/2002 | Kruger et al. | |
| 6,549,603 | B1 | 4/2003 | Ishida et al. | |
| 6,697,449 | B2 | 2/2004 | Hettiarachchi et al. | |
| 6,714,618 | B1 | 3/2004 | Hettiarachchi et al. | |
| 6,724,854 | B1 | 4/2004 | Kim et al. | |
| 6,740,168 | B2 | 5/2004 | Rootham et al. | |
| 6,793,883 | B2 | 9/2004 | Andresen et al. | |
| 6,940,939 | B1 | 9/2005 | Ichikawa et al. | |
| 6,944,254 | B2 | 9/2005 | Kormuth et al. | |
| 7,264,770 | B2 | 9/2007 | Andresen et al. | |
| 7,344,602 | B2 | 3/2008 | Varrin et al. | |
| 7,346,140 | B2 | 3/2008 | Ichikawa et al. | |
| 7,823,396 | B2 * | 11/2010 | Al-Mayahi | F28F 25/00 62/118 |
| 7,844,024 | B2 | 11/2010 | Hosokawa et al. | |
| 7,864,914 | B2 | 1/2011 | Ishida et al. | |
| 7,869,557 | B2 | 1/2011 | Ishida et al. | |
| 7,889,828 | B2 | 2/2011 | Hosokawa et al. | |
| 8,054,933 | B2 | 11/2011 | Tran et al. | |
| 8,175,211 | B2 | 5/2012 | Ishida et al. | |
| 8,353,990 | B2 | 1/2013 | Gassen et al. | |
| 8,433,030 | B2 * | 4/2013 | Fruzzetti | G21C 17/0225 376/306 |
| 8,457,270 | B2 | 6/2013 | Hosokawa et al. | |
| 8,919,388 | B2 | 12/2014 | Boday et al. | |
| 9,076,559 | B2 * | 7/2015 | Nishimura | G21D 3/08 |
| 9,280,688 | B2 | 3/2016 | Lockamon et al. | |
| 9,290,851 | B2 | 3/2016 | Gill et al. | |
| 9,299,463 | B2 * | 3/2016 | Ito | G21C 17/0225 |
| 9,498,802 | B2 * | 11/2016 | Varrin, Jr. | B08B 9/027 |
| 10,453,576 | B2 * | 10/2019 | Devito | C23F 11/18 |
| 2002/0026604 | A1 | 2/2002 | Bissett et al. | |
| 2002/0101953 | A1 * | 8/2002 | Hettiarachchi | G21C 17/0225 376/306 |
| 2002/0191731 | A1 | 12/2002 | Marble | |
| 2005/0105670 | A1 | 5/2005 | Kormuth et al. | |
| 2006/0193425 | A1 | 8/2006 | Lockamon et al. | |
| 2006/0243602 | A1 * | 11/2006 | Andresen | B01J 35/0013 205/724 |
| 2010/0135450 | A1 | 6/2010 | Fruzzetti et al. | |
| 2011/0218094 | A1 | 9/2011 | Hettiarachchi et al. | |
| 2012/0069949 | A1 * | 3/2012 | Yaita | G21F 9/001 376/305 |
| 2015/0073198 | A1 * | 3/2015 | Ishida | G21F 9/004 588/1 |
| 2015/0085967 | A1 | 3/2015 | Ueyama et al. | |
| 2016/0035442 | A1 | 2/2016 | Devito et al. | |
| 2019/0202694 | A1 * | 7/2019 | Clark | C01B 17/806 |

FOREIGN PATENT DOCUMENTS

| | | | | |
|---|---|---|---|---|
| EP | 1719824 | | 11/2006 | |
| EP | 1 750 285 | | 2/2007 | |
| EP | 2348142 | B1 * | 12/2018 | F28G 9/00 |
| EP | 2356376 | B1 * | 8/2019 | F22B 37/483 |
| JP | 3-14155 | | 2/1991 | |
| JP | 5-66999 | | 9/1993 | |
| JP | H08-226994 | A | 9/1996 | |
| JP | 10186085 | A * | 7/1998 | |
| JP | H10-186085 | | 7/1998 | |
| JP | 2001091688 | A * | 4/2001 | |
| JP | 2010-43956 | | 2/2010 | |
| JP | 2012-247322 | | 12/2012 | |
| JP | 2012247322 | A * | 12/2012 | |
| JP | 2014-163811 | | 9/2014 | |
| JP | 2016-102727 | | 6/2016 | |
| JP | 2016102727 | A * | 6/2016 | |
| WO | WO 00/22627 | | 4/2000 | |
| WO | 01/27932 | | 4/2001 | |

OTHER PUBLICATIONS

Extended Search Report issued in corresponding European Patent Application No. 17837681.0, dated Mar. 23, 2020.
Final Office Action issued in corresponding Japanese Patent Application No. 2018-516416, dated Mar. 24, 2020.
International Search Report and Written Opinion issued for International Patent Application No. PCT/US2017/045295, dated Feb. 22, 2018.
Notice of Allowance issued in corresponding Japanese Patent Application No. 2018-516416, dated May 11, 2021.

* cited by examiner

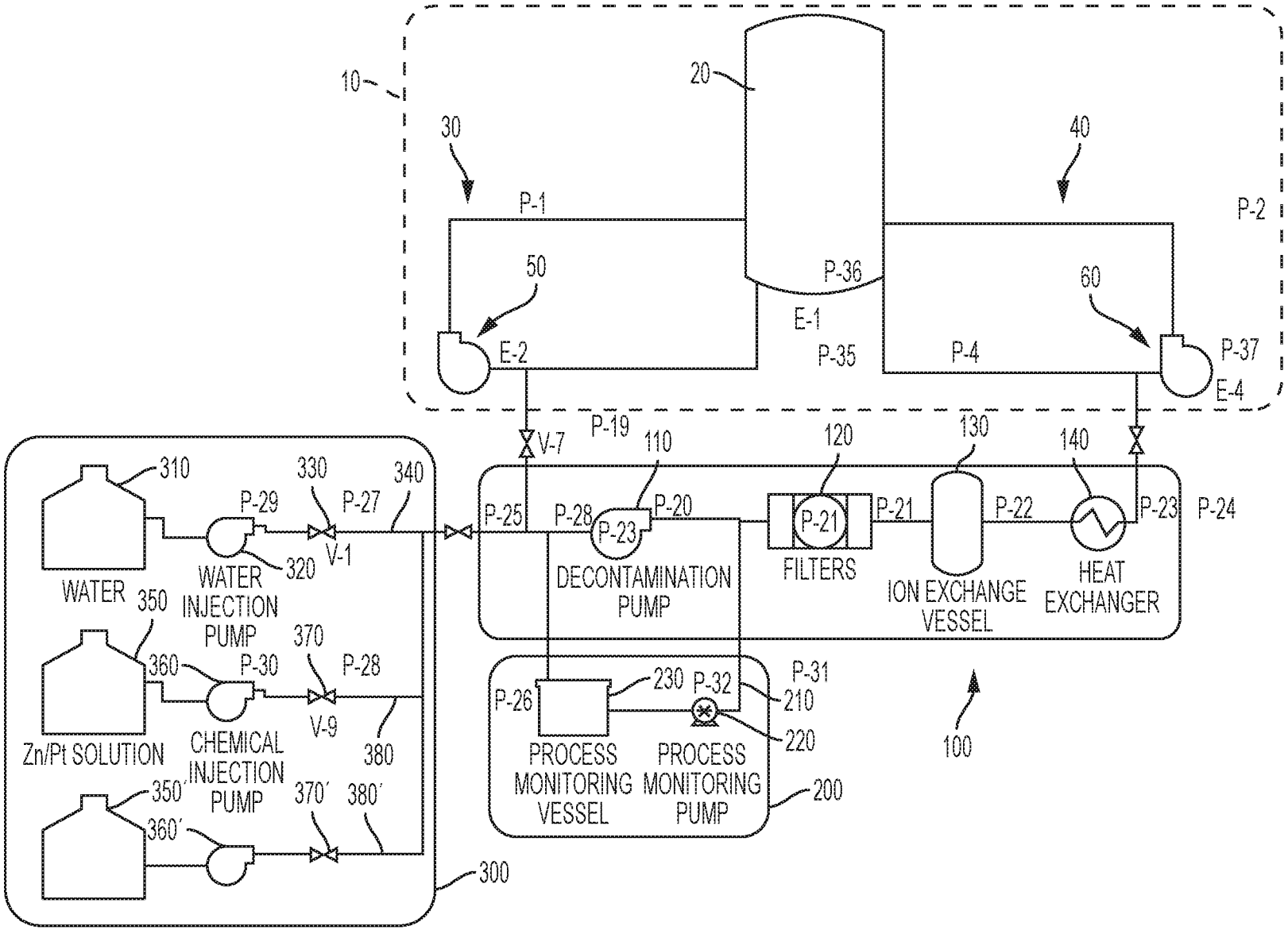
10
20
30
40
50
60
100
110
120
130
140
200
210
220
230
300
310
320
330
340
350
350'
360
360'
370
370'
380
380'
P-1
P-2
P-4
P-19
P-20
P-21
P-22
P-23
P-24
P-25
P-26
P-27
P-28
P-29
P-30
P-31
P-32
P-35
P-36
P-37
E-1
E-2
E-4
V-1
V-7
V-9
HEAT EXCHANGER
ION EXCHANGE VESSEL
FILTERS
DECONTAMINATION PUMP
PROCESS MONITORING VESSEL
PROCESS MONITORING PUMP
WATER
WATER INJECTION PUMP
Zn/Pt SOLUTION
CHEMICAL INJECTION PUMP

SUPPRESSION OF RADIONUCLIDE DEPOSITION ON NUCLEAR POWER PLANT COMPONENTS

CROSS REFERENCE

This application is the U.S. National Stage of PCT/US2017/045295, filed Aug. 3, 2017, which in turn claims the benefit of priority from U.S. Provisional Patent Application No. 62/371,188, filed Aug. 4, 2016, titled "ZINC DEPOSITION IN A NUCLEAR POWER PLANT," the entire contents of which are hereby incorporated by reference herein.

BACKGROUND

1. Field of the Invention

Various embodiments relate generally to the deposition of zinc on surfaces of a coolant loop of a nuclear power plant.

SUMMARY

Zinc is injected into the primary coolant loop of nuclear power plants during normal operation in order to reduce radiation fields. Specifically, corrosion products and metal ions present in the recirculating reactor water are incorporated into oxide films as these oxides form and grow on plant piping at high temperature during normal operation (260° C. or higher for boiling water reactors (BWRs) and ~300° C. for pressurized water reactors (PWRs)). If these corrosion products have been previously activated in the reactor core of the plant, they increase the radiation fields in the vicinity of plant piping and contribute to radiation exposure of plant workers during maintenance activities. Injection of zinc at high temperature (260° C. or higher) during normal power-generating operation limits the incorporation of activated corrosion products present in the reactor water and effectively reduces radiation fields and worker exposure, most likely because zinc competes with activated corrosion products (Co-58, Co-60, etc.) typically observed in reactor water in nuclear power plants for incorporation into oxide films. Zinc is also effective in reducing rates of primary water stress corrosion cracking (PWSCC) and intergranular stress corrosion cracking (IGSCC) in plant piping and components.

Nuclear power plants are periodically shut down for refueling outages and/or maintenance. While oxide formation is generally negligible under conditions expected during refueling outages, it has been discovered and demonstrated that according to one or more embodiments, deposition of zinc particles on coolant loop piping materials such as stainless steel can be achieved at low temperature (i.e., temperatures below the 260° C. or higher normal operating temperatures of a plant) and that these particles remain adherent to the piping materials of construction when the plant returns to operating conditions and temperatures. As a result, the oxide films that subsequently form on these surfaces during normal power-generating operation are enriched in zinc relative to untreated surfaces. Accordingly, the concentration of activated corrosion products present in these films after subsequent operation are lower than in untreated surfaces and the radiation fields present in the vicinity of piping is reduced according to one or more non-limiting embodiments.

Such low temperature zinc deposition may occur (1) before initial hot functional testing of the plant prior to initial power-generating production, and/or (2) during a stoppage of plant operation (e.g., during a refueling stoppage), preferably after a treatment is done to at least partially remove previously formed oxide films containing radioactive species from the surfaces of the primary coolant loop to be treated (which is most often performed by chemical decontamination). Hot functional testing is described in, for example, U.S. Pat. No. 9,076,559.

According to various embodiments, low temperature deposition of zinc, such as during refueling outages, is beneficial because zinc can be deposited before zinc begins to compete with activated corrosion products for incorporation into oxide films that form during subsequent plant operation. As noted above, in addition to reducing the uptake of activated corrosion products and resulting dose rates, zinc deposition may also mitigate degradation of plant piping and components (such as by PWSCC and IGSCC). Low temperature zinc deposition according to various embodiments can also be combined with deposition of other beneficial additives such as one or more noble metals to form an adherent layer comprising Zn and one or more noble metals on surfaces of piping and components in the primary coolant loop during a non-power operation period such as a refueling outage. This adherent layer is then incorporated into oxide films that form in the high temperature reactor coolant during subsequent power operation, resulting in oxides that are enriched in Zn and one or more noble metals, allowing for enhanced IGSCC mitigation and suppression the incorporation of radioactive species into the oxide films. Finally, at low temperature there is reduced risk that the added zinc will be preferentially deposited on fuel assemblies, increasing operability and corrosion risks. Zinc addition at operating conditions may lead to preferential deposition on the fuel assemblies because they are the hottest surface in the system, generally with some boiling occurring on the fuel surface.

One or more non-limiting embodiments provide a process for depositing zinc on plant piping and surfaces at nuclear power plants at low temperature such as during refueling outages or before the plant begins hot functional testing and power-generating operation, or during other non-power operation periods. According to various embodiments, this process is applied on piping surfaces with no oxide films present such as the piping condition expected before the plant begins power-generating operation or hot functional testing or after a chemical decontamination process is applied to remove the oxide films. However, the process may also be applied with oxide films present on piping and plant surfaces in order to improve the characteristics of subsequent oxide growth or to accelerate subsequent modification of existing films.

According to one or more non-limiting embodiments, low temperature zinc deposition during non-power operation periods may result in an adherent film containing zinc on the surface of piping and components in the primary coolant loop of a nuclear power plant, said film being later incorporated into oxide films that form during subsequent plant operation at high temperature such that resulting oxide films are enriched in zinc and contain lower concentrations of activated corrosion products.

According to one or more non-limiting embodiments, low temperature zinc deposition may result in lower radiation fields and worker exposure.

According to one or more non-limiting embodiments, low temperature zinc deposition may result in reduced corrosion of plant piping, particularly mitigation of intergranular stress corrosion cracking (IGSCC) of austenitic stainless steels, during subsequent plant operation.

One or more non-limiting embodiments provide a method that includes: taking a nuclear power plant from a power-generating mode to a non-power-generating mode; after taking the plant to the non-power-generating mode, and while the nuclear plant is in the non-power-generating mode, providing a treatment solution comprising zinc within a portion of a coolant loop of the nuclear plant, allowing the treatment solution to remain in the portion for a treatment period, and removing the treatment solution from the portion; and after said providing, allowing, and removing, returning the plant to the power-generating mode.

According to one or more embodiments, an average temperature of said treatment solution over the course of the treatment period is less than 150° C. and/or 100° C.

According to one or more embodiments, the treatment solution is maintained throughout the treatment period at a temperature less than 150° C. and/or 100° C.

According to one or more embodiments, the treatment period is less than 30, 20, 10, 7, and/or 5 days. According to one or more embodiments, the treatment period is between 4 hours and 4 days.

According to one or more embodiments, prior to said providing, the portion of the coolant loop had been previously exposed to radioactive corrosion products while the plant was in the power-generating mode.

According to one or more embodiments, the portion comprises a primary coolant loop of the nuclear power plant.

According to one or more embodiments, said solution contains at least 0.5 ppm zinc. The zinc may be present in said solution as zinc acetate. The zinc in the solution may be isotopically depleted in Zn-64. The solution may comprise a reducing agent (e.g., at least 50 ppm concentration) such as hydrazine, hydrazine tartrate, carbohydrazide, diethylhydroxylamine, formaldehyde, and/or erthorbic acid.

According to one or more embodiments, said portion comprises a portion of a first coolant loop, the treatment period comprises a first treatment period, and said removing comprises transferring the solution from the portion of the first coolant loop to a portion of a second coolant loop of the nuclear plant. The method according to one or more embodiments further includes, before returning the plant to the power-generating mode: allowing the solution to remain in the portion of the second coolant loop for a second treatment period, and removing the solution from the portion of the second coolant loop.

According to one or more embodiments, the method includes heating the solution that is removed from the portion of the first coolant loop before it is transferred into the portion of the second coolant loop.

According to one or more embodiments, said solution contains at least one noble metal. The at least one noble metal may include platinum, rhodium, palladium or iridium. A concentration of said at least one noble metal in the solution may be at least 0.5 ppm.

According to one or more embodiments, the method also includes, between said removing and said returning: verifying a concentration of adherent zinc particles adhering to one or more surfaces of the portion; and verifying a concentration of adherent noble metal particles adhering to one or more surfaces of the portion.

According to one or more embodiments, the method also includes, between said removing and said returning: verifying a concentration of adherent zinc particles adhering to one or more surfaces of the portion.

According to one or more embodiments, said treatment period occurs during a refueling outage of the nuclear plant.

According to one or more embodiments, said treatment period occurs after a chemical decontamination process has been performed to remove pre-existing oxide films from a surface of the portion.

According to one or more embodiments, said treatment solution comprises a first treatment solution, and said treatment period occurs after exposing the portion to a second treatment solution comprising one or more noble metals with no zinc present.

According to one or more embodiments, said providing comprises: providing within the portion a first treatment solution comprising one or more noble metals with no zinc present; and while the first treatment solution is in the portion, injecting a second solution comprising zinc into the portion to form a third treatment solution that comprises the first and second solutions.

According to one or more embodiments, the solution comprises a first solution, and the method further comprises, before said providing of the first solution in the portion: providing within the portion a second treatment solution comprising one or more noble metals with no zinc present in the second treatment solution; allowing the second solution to remain in the portion for a second solution treatment period, and removing the second solution from the portion.

According to one or more embodiments, the solution comprises a first solution, and the method further comprises, after said providing and removing of the first solution: providing a second treatment solution comprising one or more noble metals with no zinc present in the second solution; allowing the second treatment solution to remain in the portion for a second solution treatment period, and removing the second solution from the portion.

According to one or more embodiments, the treatment solution comprises a first treatment solution, and the method further comprises, after said providing and before said removing of the first solution: injecting a second solution comprising one or more noble metals into the portion such that the first and second solutions mix to form a third treatment solution comprising the one or more noble metals and zinc; allowing the third treatment solution to remain in the portion for a third solution treatment period, and removing the third solution from the portion.

One or more embodiments provides a method that includes: providing within a portion of a coolant loop of a nuclear power plant a treatment solution comprising zinc; allowing the treatment solution to remain in the portion for a treatment period; and removing the treatment solution from the portion. An average temperature of said treatment solution over the course of the treatment period is less than 150° C. and/or 100° C.

According to one or more embodiments, said providing, allowing, and removing all occur before the plant is first put into a power-generating mode.

According to one or more embodiments, said providing, allowing, and removing all occur before hot functional testing of the plant.

According to one or more embodiments, said providing, allowing, and removing all occur during a refueling outage of the nuclear plant.

One or more embodiments provides a nuclear power plant that includes: a reactor, a coolant loop comprising a surface within the coolant loop; and a layer deposited on the surface. The layer includes zinc particles (preferably metallic) in which an oxide layer, if present, on the zinc particles is less than 100 nm thick. According to one or more embodiments, the layer further includes one or more deposited noble metals.

According to one or more embodiments, the layer is a first layer, the plant further includes a second layer that is disposed on the surface and incorporates the constituents of the first layer, and the second layer comprises oxides.

According to one or more embodiments, the layer is deposited on the surface without an intermediate layer of oxide between the layer and the surface.

According to one or more embodiment, the treatment solution may be introduced with zinc only for a portion of the treatment period, and one or more noble metals may be added to said solution during a second portion of the treatment period without draining or removing the zinc from said solution, wherein said treatment period is a low temperature, non-operating period.

According to one or more embodiment, the treatment solution may be introduced with one or more noble metals only for a portion of the treatment period, and a zinc containing solution or zinc particles may be added to said solution during a second portion of the treatment period without draining or removing the one or more noble metals from said solution, wherein said treatment period is a low temperature, non-operating period.

One or more of these and/or other aspects of various embodiments of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. In one embodiment, the structural components illustrated herein are drawn to scale. It is to be expressly understood, however, that the drawings are for the purpose of illustration and description only and are not intended as a definition of the limits of the invention. In addition, it should be appreciated that structural features shown or described in any one embodiment herein can be used in other embodiments as well. As used in the specification and in the claims, the singular form of "a", "an", and "the" include plural referents unless the context clearly dictates otherwise.

All closed-ended (e.g., between A and B) and open-ended (greater than C) ranges of values disclosed herein explicitly include all ranges that fall within or nest within such ranges. For example, a disclosed range of 1-10 is understood as also disclosing, among other ranges, 2-10, 1-9, 3-9, etc.

BRIEF DESCRIPTION OF THE DRAWINGS

For a better understanding of various embodiments as well as other objects and further features thereof, reference is made to the following description which is to be used in conjunction with the accompanying FIG. 1, which is a diagram illustrating a zinc deposition process according to one or more non-limiting embodiments.

DETAILED DESCRIPTION OF EXEMPLARY EMBODIMENTS

FIG. 1 illustrates an embodiment that provides low temperature zinc deposition during a non-power-generating mode of a nuclear power plant 10 (e.g., during an outage for refueling and/or maintenance, etc.).

The plant 10 includes a reactor 20, first and second primary coolant loops 30, 40 that recirculate primary coolant through the reactor core, and first and second primary loop recirculation pumps 50, 60 to recirculate primary coolant through the loops 30, 40. The plant 10 may comprise any type of nuclear power plant (e.g., BWR, PWR). The plant 10 additionally includes other well-known components of a nuclear power plant, depending on the type of plant (e.g., turbines, heat exchangers, secondary coolant loops for PWRs). The loops 30, 40 comprise piping (e.g., comprising stainless steel) and other components whose inside surfaces are exposed to primary coolant. During power-generating operation, radioactive corrosion products tend to form an oxide layer on these inner surfaces of the loops 30, 40.

A decontamination skid 100 removably attaches to the first and/or second loops 30, 40 to facilitate, for example, a chemical decontamination process to partially or completely remove an oxide layer from the inner surfaces of the loops 30, 40 (e.g., inner surfaces of metal piping that forms the conduits of the loops 30, 40) during a plant outage after normal operation. As shown in FIG. 1, the decontamination skid 100 comprises a decontamination pump 110, filters 120, an ion exchange vessel 130, and a heat exchanger or heater 140. However, according to various embodiments, the skid 100 is omitted, and remaining equipment (e.g., the skids 200, 300) is connected directly to the loops 30, 40.

As shown in FIG. 1, a process monitoring skid 200 connects to the piping of the decontamination skid 100 both upstream and downstream from the pump 110 so as to form a monitoring loop 210 that continuously samples the solution flowing through the pump 110. The process monitoring skid 200 includes a process monitoring pump 220 and a process monitoring vessel 220 that monitor a concentration of zinc and/or noble metal (e.g., platinum, rhodium, palladium, iridium) in the solution. According to alternative embodiments, the process monitoring skid 200 may connect to any other suitable portion of the conduits (e.g., piping) containing the solution to be monitored. According to alternative embodiments, the monitoring system and skid 200 may be eliminated altogether.

As shown in FIG. 1, a zinc and noble metal injection skid 300 includes a water supply 310 (e.g., a tank of water, a pipe connected to a source of water, etc.), a water injection pump 320, and a valve 330 sequentially connected to each other via a water piping conduit 340. The skid 300 also includes at least one concentrated metal solution supply 350 (e.g., a holding tank containing the solution), a chemical injection pump 360, and a valve 370 sequentially connected to each other via a chemical piping conduit 380. The skid 300 may also include one or more additional/parallel sets of a concentrated metal solution supply 350', pump 360', valve 370', and conduit 380'. In the illustrated embodiment, the supply 350 contains a zinc solution, while the supply 350' contains a noble metal solution with no or substantially no zinc. However according to alternative embodiments, a single supply 350 that contains a solution with both zinc and may optionally include one or more noble metals may alternatively be used. According to various embodiments, the additional supply/supplies 350' may be omitted entirely.

The water and chemical solution supplies 310, 350, 350' may include heaters that maintain the solutions therein at a desired temperature. Additionally and/or alternatively, the solution may be heated to a desired temperature in the decontamination skid 100 before injection into the loops 30, 40. In alternate embodiments in which the decontamination skid 100 is not used, one or more additional or alternate heaters may be used. The conduits 340, 380, 380' merge and connect to the piping of the decontamination skid 100.

The various skids 100, 200, 300 include appropriate piping/conduits (e.g., rigid and/or flexible piping), valves, and connectors to facilitate the connections shown in FIG. 1 so as to operatively connect the skids 100, 200, 300 to the plant 10 and then disconnect the skids 100, 200, 300 from the plant 10. The skids 100, 200, 300 are typically only used temporarily (e.g., during refueling, outages or other non-power operation periods during which plant maintenance activities may be performed), so the skids 100, 200, 300 may be taken to and used at a different nuclear power plant when not being used with the plant 10.

Hereinafter, a method of low temperature zinc deposition is described with reference to FIG. 1. During power-generating operation of the plant 10, the coolant in the loops 30, 40 remains relatively hot (for example, 260° C. or higher for BWRs and ~300° C. for PWRs), such that oxides (e.g., including radioactive corrosion products) form on the inner surfaces of the loops 30, 40. To facilitate refueling and/or other maintenance, the plant 10 is taken from an online, power-generating mode to an offline, non-power-generating mode. While offline, the temperature in the loop 30, 40 is typically reduced, for example to under 100° C. While offline, the skids 100, 200, 300 are attached to the loops 30, 40. A conventional chemical cleaning process may be initially performed to reduce or remove oxides from the coolant-exposed surfaces of the loops 30, 40.

After such chemical cleaning, a solution containing water from the supply 310, zinc from the supply 350, optionally one or more noble metals (e.g., platinum, rhodium, palladium and/or iridium) from the supply 350', optionally a reducing agent, and optionally a pH adjustment agent or other additives, are transferred from the skid 300 into the primary loop 30 via the piping of the decontamination skid 100. The transferred solution may be concentrated and mixed with a different solution (e.g., water) in the loop 30 to form a lower concentration treatment solution in situ within the loop 30. The pump 50 recirculates the solution through the loop 30. The solution is allowed to remain in the loop 30 for a treatment period, and is then removed from the loop 30 (e.g., via draining). The plant 10 is then returned to the power-generating mode.

According to various embodiments, the treatment solution injected into or formed/provided within the loop 30 contains (1) at least 0.01, 0.1, 0.5, 0.9, 1, 1.5, 2, 3, 4, 5, 10, 15, and/or 20.0 ppm zinc, (2) less than 100, 75, 50, 40, 30, 25, 20, 10, 9, 8, 7, 6, 5, 4, 3, 2, and/or 1 ppm zinc, and/or (3) any zinc concentration between any two such values (e.g., between 0.01 and 100 ppm, such as between 0.2 and 15 ppm). Increasing the concentration of zinc in the solution may advantageously enhance the extent of zinc deposition on the surfaces of the loop 30. According to various embodiments, potential zinc concentrations in the solution in the coolant loop 30 can be higher when the plant 10 is offline than what is possible, allowable, and/or feasible when the plant 10 is online and producing power. For example, in one embodiment, zinc may be maintained at around 5 ppm in the treatment solution, whereas a typical target concentration during normal plant 10 operation is 5 ppb of zinc. According to various embodiments, the zinc is added to the solution and/or suspension as zinc acetate or zinc oxide, although other zinc compounds may be utilized. The zinc may be provided as a slurry or paste of zinc oxide. As used herein, a concentration of zinc in a solution means a concentration of all zinc species (e.g., zinc acetate, zinc oxide, etc.). According to various embodiments, the zinc in the solution and/or suspension is isotopically depleted in Zn-64. According to various embodiments, the skid 200 may be used to monitor the zinc concentration in the solution flowing through the loop 30. If the concentration falls below a desired concentration during the treatment period, additional zinc may be added to the solution from the supply 350.

As used herein, the term "solution" may be (1) a formulation in which substances are dissolved in the carrier (e.g., water), and/or (2) a formulation in which substances are suspended or not dissolved (e.g., slurries). The concentration of a substance (e.g., zinc) in a solution encompasses both dissolved and non-dissolved components of the substance, and refers only to the elemental portion of the species of interest (e.g., total ionic and particulate zinc, excluding any associated anions, oxygen or other species present in undissolved oxides or salts, etc.). For example, if a solution comprises 1 ppm of dissolved zinc and 1 ppm of suspended zinc (i.e., elemental zinc present in suspended zinc oxide or undissolved salts), the zinc concentration would be 2 ppm.

As used herein, unless otherwise specifically stated, concentrations (e.g., parts-per-million (ppm), parts-per-billion (ppb)) are on a mass basis. For example, ppm is the same as mg/kg.

According to various embodiments, a concentration of noble metal(s) in the treatment solution within the loop 30 is at least 0.01, 0.1, 0.5, 0.9, 1.0, 1.5, 2.0, 3.0, 4.0, 5.0, 10.0, 15.0, and/or 20.0 ppm, (2) less than 100, 75, 50, 40, 30, 25, 20, 10, 9, 8, 7, 6, 5, 4, 3, 2, and/or 1 ppm, and/or (3) any concentration between any two such values (e.g., between 0.01 and 100 ppm, such as between 0.2 and 15 ppm). According to alternative embodiments, the noble metal(s) are omitted entirely from the solution.

According to various embodiments in which a treatment solution comprising zinc but little or no noble metals is provided within the portion of the coolant loop, a concentration of noble metals within the treatment solution may be less than 500, 400, 300, 200, 100, 75, 50, 40, 30, 25, 20, 10, 9, 8, 7, 6, 5, 4, 3, 2, 1, 0.5, 0.1, 0.05, 0.01, 0.005, and/or 0.001 ppb. As used herein, the term noble metals includes all noble metal species.

Conventionally, both zinc and noble metals have been added to the primary coolant of nuclear reactors at high temperature during normal operation. Because oxides form readily on piping and components in the primary coolant loop at high temperature, zinc, noble metals and other species recirculating in the reactor water during normal operation are incorporated into these oxide films. The primary purpose of zinc addition during normal reactor operation is to suppress the incorporation of radionuclides into these oxide films, and also to improve the corrosion resistance of piping and components in the primary coolant loop. The primary purpose of noble metal addition during normal reactor operation is to improve the corrosion resistance of piping and components in the primary coolant loop, and in particular to mitigate intergranular stress corrosion cracking in BWRs.

Noble metals have also been added to water present in the primary coolant loop of nuclear reactors at low temperature such as during refueling outages and other non-power operating periods. The primary purpose of noble metal addition during low temperature, non-power operating periods is the same as during normal, high temperature operation. However, fundamental deposition principles are different when noble metals are deposited during low temperature, non-power operating periods in that the noble metals are deposited when no appreciable oxide formation is occurring. That is, the noble metals are deposited in an adherent layer at low temperature and then subsequently incorporated into oxide films that form and grow when the plant returns to high temperature operation, or at a minimum, the noble metal particles remain adherent and protect piping and component surfaces from corrosion mechanisms such as stress corrosion cracking until online noble metal addition during normal plant operation can be restarted.

To date, zinc has not been conventionally added to water present in the primary coolant loop of nuclear reactors at low temperature such as during refueling outages and other non-power operating periods because: 1) zinc interferes with noble metal deposition in prior art low temperature, non-power operation applications and 2) no suitable method or formulation was available for establishing an adherent layer containing zinc or zinc and one or more noble metals at low temperature. In view of the above, and since no appreciable oxide formation occurs during low temperature, non-operating periods, zinc addition during this time was conventionally viewed as detrimental when combined with noble metals addition and of no benefit when performed independently. However, Applicant has discovered that under various non-limiting formulations of zinc and noble metals that both zinc and noble metal(s) can be effectively deposited simultaneously and synergistically during low temperature, non-operating periods to form an adherent layer containing both zinc and noble metal(s) on piping and components in the primary coolant loop of nuclear power plants, such that oxide films that form when the plant returns to high temperature operation are enriched in zinc and noble metal(s). Additionally, Applicant has discovered that under various non-limiting formulations of zinc that zinc can effectively be deposited at low temperature, non-power operating conditions to form a layer that is adherent and generally avoids or minimizes detrimental effects to the reactor upon return to normal power operation, such as the release of deleterious impurities into the reactor coolant. In view of the above, the deposition of zinc during low temperature, non-operating periods according to various non-limiting embodiments is significant for dose mitigation purposes. In particular, various non-limiting embodiments are beneficial because zinc and noble metal(s) are present on piping and component surfaces during the first few weeks or months of high temperature operation upon return to normal power operation of a nuclear power plant when oxide films form most rapidly, and it may be challenging to add zinc or noble metals to the reactor coolant at this time due to operational limitations or fuel integrity limitations. Specifically, during and immediately following the startup or restart of a nuclear power plant, plant workers are typically focused on establishing safe, effective and steady state operation of the reactor such that limited time may be available for adding and monitoring supplemental chemistry additives. Further, online addition of zinc or noble metal(s) may not be practical during the first few months of the operating cycle due to concerns that these species may preferentially deposit on the fresh metal surfaces of newly inserted fuel assemblies and detrimentally affect fuel performance or integrity. Fuel integrity concerns may be exacerbated by the presence of elevated concentrations of silica and nickel in the reactor water at the start of a power operating cycle due to outage activities, with fuel suppliers prohibiting the addition of zinc until silica and nickel concentrations have been returned to acceptably low values following return to normal power operation. Following treatment according to various non-limiting embodiments and subsequent exposure to simulated primary coolant conditions during normal operation of a nuclear power plant, oxides formed on stainless steel test specimens exhibited 40% enrichment in zinc, compared to control specimens. Additionally, oxides formed on stainless steel test specimens pretreated with solutions according to various non-limiting embodiments disclosed herein exhibited noble metal concentrations that were comparable to or greater than those exposed to various conventional noble metal treatments applied at low temperature, non-power operation conditions.

According to various non-limiting embodiments, zinc is added to water present in the primary coolant loop of a nuclear reactor during a lower temperature, non-operating period at a concentration between 1 and 5 ppm, with pH adjusted to 7 to 11. The solution may also include an organic carrier to enhance deposition and surface adhesion such as ethylsilicate, ethylhexanoate, ethylxanthate, polydimethylsiloxane, ethylenediaminetetraacetic acid, ethylenediamine, dimethylamine, triethanolamine, or other organic species or combinations thereof. After an adherent zinc layer with a surface loading of >0.1 microgram/cm$^2$ zinc and preferably >1 microgram/cm$^2$ zinc has been established, and after equilibrium has been established between the concentration of zinc present in solution and deposited on the surfaces (as indicated by a slowing in the deposition rate) during the first treatment period, one or more noble metals may be injected directly into the first solution (without draining or removing the zinc from the first solution) at a concentration between 1 and 5 ppm to achieve a zinc to noble metal molar ratio of about 1 to begin a second treatment period. According to various embodiments, the zinc:noble-metal molar ratio in the treatment solution at the beginning of the second treatment period (or any other treatment period that involves the use of a solution comprising both zinc and one or more noble metals) is (1) greater than 0.1, 0.2, 0.3, 0.4, 0.5, 0.6, 0.7, 0.8, 0.9, 1.0, 1.1, 1.2, 1.3, 1.4, 1.5, 1.6, 1.7, 1.8. 1.9, 2.0, 2.5, 3.0. 3.5, 4.0, 4.5, 5.0, 7.5, and/or 10.0, (2) less than 15.0, 10.0, 7.5, 5.0, 4.5, 4.0, 3.5, 3.0, 2.5, 2.0, 1.9, 1.8, 1.7, 1.6, 1.5, 1.4, 1.3, 1.2, 1.1, 1.0, 0.9, 0.8, 0.7, 0.6, 0.5, 0.4, 0.3, and/or 0.2, (3) and/or between any two such numbers (e.g., between 0.1 and 15.0, between 0.2 and 10.0, between 0.2 and 5.0, between 0.5 and 1.5). After an adherent zinc and noble metal layer with a surface loading of >0.1 microgram/cm$^2$ zinc and >0.1 microgram/cm$^2$ of noble metal(s), and preferably >1 microgram/cm$^2$ zinc and >1 microgram/cm$^2$ noble metal(s), has been established during the second treatment period, the zinc, noble metals and other additives are removed from this solution by ion exchange or other means prior to returning to normal power operation. Alternatively, this solution may be drained and the primary coolant loop may be refilled with a separate source of water prior to returning to power operation.

According to various non-limiting embodiments, noble metal(s) are added to water present in the primary coolant loop of a nuclear reactor during a lower temperature, non-operating period at a concentration between 1 and 5 ppm. After an adherent noble metal layer with a surface loading of >0.1 microgram/cm$^2$ noble metal and preferably >1 microgram/cm$^2$ noble metal has been established, and after equilibrium has been established between the concentration of noble metal present in solution and deposited on the surfaces (as indicated by a slowing in the deposition rate) during the first treatment period, zinc may be injected directly into the first solution (without draining or removing the noble metals from the first solution) at a concentration between 1 and 5 ppm to achieve a zinc to noble metal molar ratio of about 1 and with pH adjusted to 7 to 11 to begin a second treatment period. The formulation may also include an organic carrier to enhance deposition and surface adhesion. After an adherent zinc and noble metal layer with a surface loading of >0.1 microgram/cm$^2$ zinc and >0.1 microgram/cm$^2$ of noble metal(s), and preferably >1 microgram/cm$^2$ zinc and >1 microgram/cm$^2$ noble metal(s), has been established during the second treatment period, the zinc, noble metals and other additives are removed from this solution by ion exchange or other means prior to returning to normal power operation. Alternatively, this solution may be drained and the primary coolant loop may be refilled with a separate source of water prior to returning to power operation.

According to various embodiments, the treatment solution also contains a reducing agent (e.g., hydrazine, carbohydrazide, diethylhydroxylamine, erthorbic acid). The reducing agent may be added to the supply 310, 350, 350' so as to be present in the solution injected into the loop 30. According to various embodiments, a reducing agent is present in the treatment solution within the loop 30 at a concentration of at least 10, 20, 30, 40, 50, 60, 70, 80, 90, 100, 150, and/or 200 ppm, (2) less than 5000, 4000, 3000, 2500, 2000, 2500, 1250, 1000, 750, 500, 400, 300, 200, 100, 75, 50, 40, 30, 25, 20, 10, 9, 8, 7, 6, 5, 4, 3, 2, and/or 1 ppm, and/or (3) any concentration between any two such values (e.g., between 10 and 500 ppm, such as between 30 and 400 ppm).

The pH of any of the treatment solutions disclosed herein may be adjusted to pH 7 or higher, for example with ammonia or another suitable base.

According to a non-limiting exemplary embodiment, the treatment solution in the loop 30 comprises 2 ppm platinum, 5 ppm zinc, and 60 ppm hydrazine. However, any combination of the above discussed concentrations of the different components of the treatment solution may be used in accordance with different embodiments.

The treatment period means the time period between when the solution is provided within the loop 30 (either by formation or injection) and when the treatment solution is removed from the loop 30. According to various embodiments, the treatment period is (1) less than 20, 15, 10, 9, 8, 7, 6, 5, 4, 3, and/or 2 days, (2) greater than 4, 5, 10, 15, 20, and/or 24 hours, and/or (3) between any two values (e.g., between 4 hours and 20 days, between 4 hours and 10 days, between 5 hours and 7 days). According to one embodiment, the treatment period is 1-2 days. This treatment period is typically available during a refueling outage, which typically lasts for multiple weeks (e.g., about one month).

According to various embodiments, the treatment solution may be heated before injection into the loop 30, during transfer between loop 30 and another loop (e.g., loop 40), and/or while the treatment solution recirculates through, in, and out of the loop 30 (e.g., through the heater 140 of the decontamination skid 100). Accordingly, a temperature of said treatment solution in the loop 30 is maintained throughout the treatment period at (1) less than 200, 150, 140, 130, 120, 110, and/or 100° C., (2) at least 10, 20, 30, 40, 50, 60, 70, 80, 85, 90, 95, 100, 110, 120, 130, and/or 140° C., and/or (3) between any two such temperatures (e.g., between 10 and 200° C., between 20 and 100° C.). According to various embodiments, the temperature of the treatment solution in the loop 30 is kept below 100° C. so as to discourage steam formation when the loop 30 is at or near atmospheric pressure. According to various embodiments, the temperature of the treatment solution in the loop 30 is kept warmer than ambient atmospheric temperatures so as to enhance zinc deposition on the surfaces of the loop 30 during the treatment period. According to one embodiment, the temperature of the treatment solution is maintained at around 93° C. during the treatment period so as to avoid steam formation while still promoting faster zinc deposition. According to one embodiment, the temperature may be changed within the target range so as to improve or optimize one or more of the following: duration of application, energy usage, deposition of zinc, absence of steaming, deposition of noble metal(s), or other process objectives.

The instantaneous temperature of the treatment solution in different parts of the loop 30 may differ. Accordingly, as used herein, the temperature of the treatment solution means the volume-weighted average temperature of the treatment solution.

According to various embodiments, an average temperature of said treatment solution in the loop 30 over the course of the treatment period (i.e., a time-based average) is (1) less than 200, 150, 140, 130, 120, 110, and/or 100° C., (2) at least 10, 20, 30, 40, 50, 60, 70, and/or 80° C., and/or (3) between any two such temperatures (e.g., between 10 and 200° C., between 20 and 100° C.). For example, if the solution temperature is 50° C. at the beginning of the treatment period and linearly increases to 90° C. at the end of the treatment period, the average temperature of the treatment solution in the loop 30 over the course of the treatment period would be 70° C.

According to various embodiments, deposition of zinc and/or one or more noble metal(s) onto the surfaces of the loop 30 and/or 40 at lower temperatures (i.e., well below the normal operating temperatures of the coolant loops 30, 40) facilitates formation of zinc and/or noble metal layers with little or no oxide formation. As a result, according to one or more embodiments, zinc and/or noble metal(s) are deposited onto piping surfaces of the loop 30 and/or 40 with no substantive oxide formation. According to one or more such embodiments, the zinc and/or noble metal particles remain adherent to the surfaces of the loop 30 and/or 40 so that when the plant 10 later returns to its higher operating temperature, the treated surfaces of the coolant loop 30 and/or 40 retain adherent zinc and/or noble metal particles that can then be incorporated into the oxide as it forms. The zinc then competes with cobalt (or other radioactive species) to reduce the deposition of such radioactive species on the inner surfaces of the coolant loop or oxide layers forming thereon.

According to various embodiments, the solution may or may not be continuously circulated through the loop 30 during the treatment period. According to one or more embodiments, the solution is not actively circulated within the loop 30 during the treatment period. According to one or more alternative embodiments, active solution circulation occurs for part or all of the treatment period (e.g., by operating the pump(s) 50, 320, 360, 360'). According to one or more alternative embodiments, natural circulation may occur as a result of transferring the solution back and forth between different loops 30, 40. According to various embodiments, the solution is substantially stagnant during the treatment period. According to various embodiments, mixing (e.g., via gas sparging) may be used to create some circulation and/or mixing of the solution during the treatment period.

According to various embodiments, providing the solution within the loop 30 and removing the solution from the loop 30 may be accomplished by way of appropriate conduits (e.g., pipes, tubes, etc.) and pump(s). For example, the pump 110 may be used to pump solution into and out of the loop 30 and/or 40.

According to various embodiments, over the course of the treatment period adherent zinc deposition onto one or more surfaces of the loop 30 (e.g., inner piping surfaces, heat exchanger surfaces exposed to primary coolant) is (1) at least 0.01, 0.05, 0.1, 0.2, 0.3, 0.4, 0.5, 0.6, 0.7, 0.8, 0.9, 1.0, 1.5, 2.0, 2.5, 3.0, 4.0, 5.0, 6.0, 7.0, 8.0, 9.0, 10, 12.5, 15, and/or 20 μg/cm$^2$ of zinc, (2) less than 500, 100, 75, 50, 25, 20, 17.5, 15, 14, 13, 12, 11, 10, 9.0, 8.0, 7.0, 6.0, and/or 5.0 μg/cm$^2$ of zinc, and/or (3) between any two such upper and lower values (e.g., between 0.01 and 500 μg/cm$^2$ of zinc; between 0.5 and 10 μg/cm$^2$ of zinc). According to various embodiments, the zinc deposition results in a discontinuous layer of zinc particles being adherently deposited onto the surfaces of the loop 30. A "discontinuous layer" means that portions of the underlying surface (be it bare loop 30 surface or an oxide or other layer thereon) remain exposed to the coolant in between the particles of deposited adherent zinc.

According to various embodiments, after removing the treatment solution from the loop 30, the plant 10 is taken back online and operated in its power-generating mode. However, according to alternative embodiments, the treatment solution is first reused to deposit zinc onto surfaces of the other primary loop 40 before taking the plant 10 back online. In one or more such embodiments, the treatment solution is drained or otherwise removed from the loop 30 and injected into the loop 40 via the piping of the decontamination skid 100. The treatment solution is allowed to remain in the loop 40 for a second treatment period, and then drained or otherwise removed from the loop 40 before the plant 10 is taken back online. The second treatment period and treatment conditions (e.g., temperatures, concentrations, etc.) may be the same as or different from the zinc deposition treatment used on the other loop 30.

According to various embodiments, the treatment solution may be reconditioned and/or heated (e.g., via the heater 140) between use in the loop 30 and injected into the loop 40. For example, additional zinc, noble metal(s), and/or reducing agent may be added to the treatment solution before it is injected into the loop 40 to provide desired concentrations of these constituents.

According to one or more alternative embodiments, the loop(s) 30, 40 are subjected to a noble metal deposition treatment before, during, and/or after the above-discussed zinc deposition treatment. The noble metal deposition treatment may be identical to the above-described zinc deposition treatment, except that the treatment solution used for the noble metal deposition treatment comprises one or more noble metals (e.g., in the above discussed concentrations) and optionally excludes zinc. According to one or more alternative embodiments, multiple alternating (1) zinc, (2) noble metal and/or (3) combined zinc and noble metal treatments may be applied.

In an embodiment that provides noble metal(s) deposition before zinc deposition, the noble metal treatment solution is drained or otherwise removed from the loop(s) 30, 40 before the zinc deposition treatment is performed using a treatment solution that comprises zinc, either with or without noble metal(s). According to alternative embodiments, the noble metal deposition treatment may occur after the zinc deposition treatment.

According to one or more alternative embodiments, the method comprises injecting into (or forming within) the loop 30 a zinc-less noble metal treatment solution, allowing the zinc-less noble metal treatment solution to remain in the loop 30 for a noble metal treatment period, and then adding zinc to the treatment solution in situ to form a treatment solution in the loop 30 that comprises both noble metal(s) and zinc. According to various embodiments, this stepwise process results in an initial layer of noble metal deposition on the inner surfaces of the loop 30, with a top layer of zinc deposition and/or zinc mixed with noble metal deposition.

As used herein, the term "zinc-less" means that there is little or no zinc present. According to various embodiments, "zinc-less" solutions have zinc concentrations less than 500, 400, 300, 200, 100, 75, 50, 40, 30, 25, 20, 10, 9, 8, 7, 6, 5, 4, 3, 2, 1, 0.5, 0.1, 0.05, 0.01, 0.005, and/or 0.001 ppb.

According to various alternative embodiments, this order is reversed so that a treatment solution comprising zinc but no noble metal(s) is injected into the loop 30 first. After a zinc treatment period, noble metal(s) are injected into the zinc treatment solution in situ to form a treatment solution that comprises both zinc and noble metal(s). According to various embodiments, this stepwise process results in an initial layer of zinc deposition on the inner surfaces of the loop 30, with a top layer of noble metal deposition and/or noble metal mixed with zinc deposition.

In one or more embodiments, a treatment solution containing 2 ppm platinum and 60 ppm hydrazine is provided within the loop 30 (e.g., via injection or in situ formation) for a first treatment period, whose treatment conditions, times, and temperatures may be identical or different than any of the above-discussed embodiments. After the first treatment period, zinc and hydrazine are added to the treatment solution in the loop 30 to form a second treatment solution containing 2 ppm platinum, 5 ppm zinc and 1000 ppm hydrazine (i.e., the first treatment solution is not removed prior to introducing the second treatment solution). Then, the inner surfaces of the loop 30 are exposed to the second treatment solution for a second treatment period, whose treatment conditions, times, and temperatures may be identical or different than any of the above-discussed embodiments.

In another embodiment of the disclosed process, one or more of the surfaces of the loop 30, 40 are exposed to a treatment solution containing 5 ppm zinc and 1000 ppm hydrazine during a first treatment period. Then, after the first treatment period, the first treatment solution is drained or otherwise removed and a second treatment solution containing 2 ppm platinum and 60 ppm hydrazine is introduced. Then, one or more of the surfaces of the loop 30, 40 are exposed to the second solution for a second treatment period.

According to various embodiments, after the zinc deposition treatment and before taking the plant 10 back online, a concentration of adherent zinc particles adhering to one or more surfaces (e.g., one or more portions) of the loop 30 and/or 40 is verified. According to various embodiments, after the zinc deposition treatment and before taking the plant 10 back online, a concentration of adherent noble metal particles adhering to one or more surfaces of the loop 30 and/or 40 additionally and/or alternatively verified.

According to various of these embodiments, while the zinc and/or noble metal(s) deposition treatment is underway, test specimens may be exposed to the treatment in parallel and periodically checked to assess the quantity of zinc that has been deposited on target surfaces and the degree of adherence of these particles. For example, test specimens may be analyzed by acid washing the surface of test specimens and analyzing the acid wash for particles of interest (zinc, noble metal(s), etc.). Additionally or alternatively, specimens may be exposed to conditions expected when the nuclear power plant 10 returns to normal power-generating operation such as flow velocities of 1 m/s or higher and normal power-generating operation temperatures, followed by reanalysis of test specimens surfaces after such exposures to assess the degree to which particles of interest were removed.

According to various non-limiting embodiments, deposition of zinc and one or more noble metals on piping, vessels and/or other components of the loop 30 and/or 40 at low temperature and/or when the plant is shut down (not generating power) may reduce plant dose rates and enhance mitigation of piping corrosion (such as by intergranular stress corrosion cracking, IGSCC). Both zinc and noble metals mitigate IGSCC. Codeposition of zinc and one or more noble metals may further enhance IGSCC mitigation relative to deposition of noble metal(s) alone.

In one or more of the above-discussed embodiments, the zinc deposition treatment is performed after the plant 10 has undergone one or more periods of power-generating operation. However, according to alternative embodiments, any of the above-discussed methods may be applied before the plant 10 undergoes its first period of power-generating operation. According to various embodiments, any of the above-discussed methods may be applied before initial hot functional tests that are conducted on the plant 10 before the plant 10 undergoes its first period of power-generating operation. According to various embodiments, any of the above-discussed methods may be applied after initial hot functional tests, but before the plant 10 undergoes its first period of power-generating operation. According to various of such embodiments, the nuclear power plant coolant loop 30, 40 is exposed to one or more treatment solutions containing zinc when the surfaces of loop 30, 40 are free of oxide films (e.g., before the loop 30, 40 is first raised to power-generating operating temperatures that promote oxide formation, or after exposure to power-generating operating temperatures followed by subsequent removal of the resulting oxide layer, or after exposure to power-generating operating temperatures without subsequent removal of the resulting oxide layer).

According to one or more embodiments, the zinc deposition treatment results in a power plant in which a first layer comprising zinc particles is deposited onto the surface(s) of the coolant loop 30 and/or 40. The first layer is substantially devoid of oxide and preferably comprises metallic zinc. As used herein, substantially devoid means that less than 100 nm of oxide is formed on the particles deposited within this first layer or on the surface(s) of the coolant loop 30 and/or 40 during the zinc deposition treatment. The first layer may also comprise other constituents (e.g., one or more deposited noble metals, as discussed above). Depending on when the zinc deposition treatment occurs (e.g., before or after power-generating operation, hot functional testing, chemical decontamination), a second layer comprising oxides (e.g., radioactive oxides) and/or noble metal(s) may be disposed between the first layer and the surface of the loop 30 and/or 40. Alternatively, the first layer is deposited on the loop's surface without an intermediate layer of oxide between the first layer and the surface. After the plant 10 is put into power-generating operation following zinc deposition, a second layer comprising oxides may form on the loop's surface, incorporating the constituents of first layer deposited during the zinc deposition treatment as this second oxide layer forms.

In the illustrated embodiment, zinc is deposited onto inner (i.e., coolant-exposed) surfaces of a primary coolant loop 30 and/or 40. However, according to alternative embodiments, zinc is deposited onto other surfaces of other components of a nuclear power plant (e.g., a secondary loop of a PWR plant, other surfaces or components that are susceptible to the buildup of activated corrosion products). One or more alternative embodiments are applicable to any other apparatus whose surface is exposed to radiation and/or susceptible to radioactive oxide layer/scale formation. One or more alternative embodiments are applicable to other apparatus whose surface is subject to corrosion mechanisms that are mitigated by the presence of zinc and/or noble metals such as stress corrosion cracking or general corrosion.

Non-limiting experiments have been conducted as follows. Test specimens were exposed to zinc test treatment solutions at 93° C. for approximately 24 hours. In several tests, zinc treatment solutions also contained noble metals. In other tests, zinc was applied alone or zinc and noble metals were applied successively (zinc, then noble metals or noble metals, then zinc). Following these exposures, the surface of each test specimen was examined by SEM/EDS to assess the coverage of zinc or noble metal particles. Test specimens were then exposed to conditions simulating those expected during normal power-generating operation of a nuclear power plant. During this exposure, specimens were exposed to high temperature water at 285° C. and a fluid velocity of 1.5 m/s was simulated by stirring. The water contained 100 ppb hydrogen, 150 ppb zinc and 30 ppb cobalt and hydrazine as needed to achieve a neutral pH. Although higher than concentrations typically present in reactor water of a nuclear power plant, the ratio of zinc and cobalt concentrations during this exposure was comparable to typical ratios observed in primary water in nuclear power plants. After this simulated exposure to nuclear power plant operating conditions, the surface of each test specimen was examined to assess the nature of the oxide film formed. Of primary interest was whether the oxide film for treated specimens contained higher concentrations of zinc than control (untreated) specimens. The concentration of noble metals (if applicable) present in oxide films on treated specimens was also compared to control (untreated) specimens.

These experiments revealed that exposing test specimens to zinc treatment solutions at low temperature (i.e., a temperature below the normal operating temperature of a primary coolant loop during commercial power-generating operation) as disclosed herein before exposing them to simulated power operation conditions (either during initial operation or after a non-operation period such as a refueling or maintenance outage) led to the formation of oxide films that contained 40% higher zinc concentrations than control (untreated) specimens or specimens exposed to conventional noble metal treatments applied at low temperature, non-power operation conditions.

Additionally, in these experiments, exposing test specimens to treatment solutions containing both zinc and platinum at low temperature as disclosed herein before exposing them to simulated power operation conditions led to the formation of oxide films that contained platinum concentrations that were up to a factor of four (4) higher than specimens pretreated using conventional noble metal treatments applied at low temperature, non-power operation conditions. That is, not only did various non-limiting embodiments disclosed herein effectively deposit an adherent zinc layer that was incorporated into the oxide film during subsequent high temperature exposure, these embodiments also beneficially enhanced the deposition and incorporation of platinum into these oxide films relative to various conventional processes.

Based on these results, one or more non-limiting examples of the above embodiments are expected to reduce the incorporation of activated corrosion products such as Co-58 and Co-60 into oxide films that form on piping and components in nuclear power plants, and thereby help to mitigate radiation fields and worker exposure. One or more non-limiting examples of the above embodiments are expected to mitigate PWSCC and IGSCC in plant piping systems and afford enhanced IGSCC mitigation in plant piping systems relative to piping that has been treated with noble metals alone, for example due to the zinc deposit's contribution to the mitigation of PWSCC and IGSCC.

According to any of the embodiments in which different treatment solutions are used at different times, an earlier treatment solution may be removed from the coolant loop by draining the solution and/or using any suitable method for removing zinc, noble metals, and/or other additives from the water in the coolant loop (e.g., ion exchange).

According to various embodiments, concentrations of substances (e.g., zinc, noble metal(s), reducing agents, organic carriers, etc.) within a treatment solution may tend to drop over the course of the treatment period. According to various embodiments, additional amounts of such substance(s) may be added to the solution during the treatment period so as to maintain the desired concentration of the substance. According to other embodiments, the concentration of such substance(s) may be allowed to drop over the course of the treatment period. Unless otherwise specifically stated, the treatment solution concentrations and molar concentration ratios discussed herein refer to the concentrations or ratios at the start of the associated treatment period.

The foregoing illustrated embodiments are provided to illustrate the structural and functional principles of various embodiments and are not intended to be limiting. To the contrary, the principles of the present invention are intended to encompass any and all changes, alterations and/or substitutions thereof (e.g., any alterations within the spirit and scope of the following claims).

What is claimed is:

1. A method comprising:

taking a nuclear power plant from a power-generating mode to a non-power-generating mode;

after taking the plant to the non-power-generating mode, and while the nuclear plant is in the non-power-generating mode:

providing a treatment solution comprising zinc within a portion of a first coolant loop of the nuclear plant, allowing the treatment solution to remain in the portion for a first treatment period, and removing the treatment solution from the portion of the first coolant loop, wherein said removing comprises transferring the solution from the portion of the first coolant loop to a portion of a second coolant loop of the nuclear plant;

allowing the solution to remain in the portion of the second coolant loop for a second treatment period;

removing the solution from the portion of the second coolant loop; and returning the plant to the power-generating mode, wherein the nuclear power plant comprises a reactor, wherein the first and second coolant loops are configured to each flow through the reactor, wherein the nuclear power plant comprises a first recirculation pump disposed in the first coolant loop for recirculating coolant through first coolant loop, and wherein the nuclear power plant comprises a second recirculation pump disposed in the second coolant loop for recirculating coolant through the second coolant loop.

2. The method of claim 1, wherein an average temperature of said treatment solution over the course of the first treatment period is less than 100° C.

3. The method of claim 2, wherein said treatment solution is maintained throughout the first treatment period at a temperature less than 150° C.

4. The method of claim 1, wherein the first treatment period is less than 10 days.

5. The method of claim 1, wherein the first treatment period is between 4 hours and 4 days.

6. The method of claim 1, further comprising adjusting the pH of the treatment solution to at least pH 7.

7. The method of claim 1, wherein prior to said providing, the portion of the first coolant loop had been previously exposed to radioactive corrosion products while the plant was in the power-generating mode.

8. The method of claim 1, wherein the first coolant loop comprises a primary coolant loop of the nuclear power plant.

9. The method of claim 1, wherein said solution comprises at least 0.5 ppm zinc.

10. The method of claim 1, wherein said solution comprises an organic carrier.

11. The method of claim 1, wherein zinc is present in said solution as zinc acetate.

12. The method of claim 1, wherein the zinc is isotopically depleted in Zn-64.

13. The method of claim 1, further comprising heating the solution that is removed from the portion of the first coolant loop before it is transferred into the portion of the second coolant loop.

14. The method of claim 1, wherein said solution comprises at least one noble metal.

15. The method of claim 14, wherein said at least one noble metal comprises platinum, rhodium, palladium or iridium.

16. The method of claim 14, wherein a concentration of said at least one noble metal in the solution is at least 0.5 ppm.

17. The method of claim 16, wherein:

a concentration of zinc in the solution is at least 0.5 ppm; and a molar ratio of zinc to noble metal within the treatment solution is at least 0.1.

18. The method of claim 17, wherein the molar ratio of zinc to noble metal within the treatment solution is between 0.5 and 1.5.

19. The method of claim 14, further comprising, between said removing of the treatment solution from the portion of the first coolant loop and said returning:

verifying a concentration of adherent zinc particles adhering to one or more surfaces of the portion of the first coolant loop; and verifying a concentration of adherent noble metal particles adhering to one or more surfaces of the portion of the first coolant loop.

20. The method of claim 1, further comprising, between said removing of the treatment solution from the portion of the first coolant loop and said returning: verifying a concentration of adherent zinc particles adhering to one or more surfaces of the portion of the first coolant loop.

21. The method of claim 1, wherein said treatment period occurs after a chemical decontamination process has been performed to at least partially remove oxides from a surface of the portion of the first coolant loop.

22. The method of claim 1, further comprising, after said taking of the nuclear power plant from the power-generating mode to the non-power-generating mode, and before said providing of the treatment solution within the portion of the first coolant loop:

performing a chemical decontamination process on the portion of the first coolant loop to at least partially remove oxides from a surface of the portion of the first coolant loop.

23. The method of claim 1, wherein said treatment solution comprises a first treatment solution, and wherein said first treatment period occurs after exposing the portion of the first coolant loop to a second treatment solution comprising one or more noble metals, wherein a concentration of zinc in the second treatment solution is less than 500 ppb.

24. The method of claim 1, wherein said providing of the treatment solution within the portion of the first coolant loop comprises:

providing within the portion of the first coolant loop a first treatment solution comprising one or more noble metals, wherein a concentration of zinc in the first treatment solution is less than 500 ppb; and while the first treatment solution is in the portion of the first coolant loop, injecting a second treatment solution comprising zinc into the portion of the first coolant loop to form a third treatment solution that comprises the first and second treatment solutions.

25. The method of claim 1, wherein:

the solution comprises a first treatment solution, and the method further comprises, after taking the nuclear power plant from the power generating mode to the non-power-generating mode, and before said providing of the first treatment solution in the portion of the first coolant loop:

providing within the portion of the first coolant loop a second treatment solution comprising one or more noble metals, wherein a concentration of zinc in the second treatment solution is less than 500 ppb; and allowing the second treatment solution to remain in the portion of the first coolant loop for a third treatment period.

26. The method of claim 25, further comprising, before said providing of the first treatment solution in the portion of the first coolant loop:

removing the second treatment solution from the portion of the first coolant loop.

27. The method of claim 25, wherein the first treatment solution provided within the portion of the first coolant loop has a noble metal concentration of less than 500 ppb.

28. The method of claim 25, wherein said providing of the first treatment solution in the portion of the first coolant loop comprises adding zinc to the second treatment solution.

29. The method of claim 1, wherein:

the solution comprises a first treatment solution, and the method further comprises, after said providing and removing of the first treatment solution, and before said returning of the plant to the power-generating mode:

providing a second treatment solution comprising one or more noble metals;

allowing the second treatment solution to remain in the portion of the first coolant loop for a third treatment period, and removing the second treatment solution from the portion of the first coolant loop.

30. The method of claim 29, wherein a concentration of noble metal in the first treatment solution is less than 500 ppb.

31. The method of claim 29, wherein a concentration of zinc in the second treatment solution is less than 500 ppb.

32. The method of claim 1, wherein: the solution comprises a first treatment solution with a noble metal concentration of less than 500 ppb, and the method further comprises, after the first treatment period, and before said removing of the first treatment solution from the portion of the first coolant loop, adding one or more noble metals to the first treatment solution to provide a second treatment solution within the portion of the first coolant loop;

allowing the second treatment solution to remain in the portion of the first coolant loop for a third treatment period, and removing the second treatment solution from the portion of the first coolant loop.

33. The method of claim 1, wherein returning the plant to the power-generating mode comprises simultaneously running the first and second recirculation pumps so as to simultaneously pump reactor coolant through each of the first and second coolant loops, respectively.

34. The method of claim 1, wherein returning the plant to the power-generating mode comprises simultaneously pumping coolant through each of the first and second coolant loops.

35. The method of claim 1, wherein the first and second coolant loops are configured so as to permit simultaneous recirculation of coolant through the first and second coolant loops.

36. The method of claim 1, wherein, outside a reactor of the nuclear power plant, the first and second coolant loops are separate from each other.

* * * * *